US011662166B2

(12) United States Patent
Overstreet et al.

(10) Patent No.: US 11,662,166 B2
(45) Date of Patent: May 30, 2023

(54) REINFORCED MAGAZINE FEED LIPS WITH REAR ACTUATED LAST ROUND BOLT HOLD OPEN AND FOLLOWER

(71) Applicant: 22 Evolution LLC, Columbia, MO (US)

(72) Inventors: John L. Overstreet, Fayette, MO (US); Jordan Maddox Wilson, Blue Springs, MO (US); Derrik Lee Roll, Columbia, MO (US)

(73) Assignee: 22 EVOLUTION LLC, Columbia, MO (US)

( * ) Notice: Subject to any disclaimer, the term of this patent is extended or adjusted under 35 U.S.C. 154(b) by 0 days.

(21) Appl. No.: 17/741,634

(22) Filed: May 11, 2022

(65) Prior Publication Data

US 2022/0364809 A1 Nov. 17, 2022

Related U.S. Application Data

(60) Provisional application No. 63/186,842, filed on May 11, 2021.

(51) Int. Cl.
*F41A 9/70* (2006.01)
*F41A 3/66* (2006.01)

(52) U.S. Cl.
CPC . *F41A 9/70* (2013.01); *F41A 3/66* (2013.01)

(58) Field of Classification Search
CPC ..... F41A 9/70; F41A 9/69; F41A 9/65; F41A 17/36
USPC ..... 42/50
See application file for complete search history.

(56) References Cited

U.S. PATENT DOCUMENTS

| | | | | |
|---|---|---|---|---|
| D672,837 | S | 12/2012 | Wyatt | |
| 8,356,439 | B2 | 1/2013 | Dubois | |
| D678,455 | S | 3/2013 | Hatfield | |
| 9,255,749 | B2 * | 2/2016 | Faifer | F41A 9/65 |
| D804,603 | S | 12/2017 | Kielsmeier et al. | |
| 10,215,516 | B2 | 2/2019 | Hefer et al. | |
| 10,422,598 | B2 | 9/2019 | McCormick | |
| 10,605,553 | B1 | 3/2020 | Collazo et al. | |
| 11,168,953 | B2 | 11/2021 | Philbin et al. | |
| 2010/0281737 | A1 | 11/2010 | Cahill | |
| 2011/0005113 | A1 | 1/2011 | Fitzpatrick et al. | |

(Continued)

FOREIGN PATENT DOCUMENTS

WO 2021194621 A3 1/2022

*Primary Examiner* — Reginald S Tillman, Jr.
(74) *Attorney, Agent, or Firm* — Dinsmore & Shohl LLP

(57) ABSTRACT

A magazine for a firearm with a magazine well and a reciprocating bolt. A body of the magazine is engaged within the well and has a top, interconnected front, sides and rear walls, and a bottom defining a cartridge holding interior. A spring supported within the interior contacts the bottom and upwardly biases a follower positioned atop the spring toward an opening in the top, through which the cartridges are loaded into the magazine. A feed tower integrated into the top supports a pair of feed lips positioned along opposed edges defining the opening. An aperture is formed in the top rearward of the feed tower. A rear upward projection of the follower aligns with the aperture and, following discharge of a final cartridge, elevates above the top in order to actuate a separate bolt catch or bolt hold open adaptor to prevent a forward returning motion of the bolt.

13 Claims, 11 Drawing Sheets

(56) References Cited

U.S. PATENT DOCUMENTS

| | | | |
|---|---|---|---|
| 2011/0167694 | A1 | 7/2011 | Bigley et al. |
| 2012/0124879 | A1 | 5/2012 | Larue |
| 2022/0065567 | A1 | 3/2022 | Philbin et al. |

* cited by examiner

REINFORCED MAGAZINE FEED LIPS WITH REAR ACTUATED LAST ROUND BOLT HOLD OPEN AND FOLLOWER

CROSS REFERENCE TO RELATED APPLICATION

The present application claims the priority of U.S. Ser. No. 63/186,842 filed May 11, 2021.

FIELD OF THE INVENTION

The present invention relates generally to a magazine, such as affixed within a magazine well of an AR type firearm. More particularly, the present invention discloses the provision of a plastic injection molded magazine having a redesign upper end including reinforced feed lips, such as incorporated into a bridge or tower integrated into the magazine construction. An area of the magazine top surrounding the feed lips is substantially closed with the exception of an upward follower projection which, upon discharging of a final round, elevates a separate bolt catch or custom drop in bolt hold adaptor into contact with the forwardly displacing bolt. Other features include forming the feed ramp integrally with specific versions of the magazine tube in order to simplify construction and reduce cost of manufacture.

BACKGROUND OF THE INVENTION

Attachable magazines are known in the relevant art, such as for use with AR type firearms. Conventional magazine construction includes each of a magazine body with a bottom attachable floor plate supporting an interior and upwardly biasing coil spring, along with a follower supported upon an upper end of the spring. Depending upon the capacity of the magazine, a plurality of cartridges are progressively loaded through feed lips configured into an upper end of magazine, downwardly compressing the interior supported and upwardly biased follower toward the floor plate. Upon inserting the magazine and progressively firing rounds from the firearm, the follower progressively displaces upwardly according to its spring bias until, following discharge of a last round, the follower is fully upwardly actuated in order to come into contact with and to arrest the forward traveling motion of the bolt in order to maintain the chamber in an open position.

Such traditional magazines are often constructed of stamped steel. More recently, injection molded plastics have been utilized in the construction of the magazines, with experienced shortcomings including instances of outward swelling of the feed lips, such as in response to prolonged periods of the inner spring exerting a constructed upward bias against the cartridges held against the feed lips of such polymer magazines. Also, known magazine designs include a substantially open top area toward the back end in order to allow room for the ascending follower to contact the vehicle bolt catch after the last round has been fired, this often further compromising the structural integrity of the magazine.

SUMMARY OF THE INVENTION

The present invention discloses a magazine for use with an AR type firearm having a lower receiver with a magazine well in communication with an attached upper receiver incorporating a reciprocating bolt. The magazine includes an elongated body installable into the magazine well and having a top, interconnected front, sides and rear walls, with a closed bottom to collectively define a cartridge holding interior.

A spring is supported within the interior in contact with the closed bottom which either defines a bottom of the magazine or a separate floor plate secured to an open lower perimeter of the magazine body to define the closed bottom. The follower is positioned atop the spring in an upwardly biased direction toward a main opening in the top, through which the cartridges are loaded into the magazine.

A feed tower or other structurally supporting structure is integrated into the top and supports a pair of connected and reinforced feed lips positioned along opposed edges defining the main opening for facilitating the loading of the cartridges. The magazine top has a separate aperture positioned rearward of the feed tower, with a rear extending and upward projection of the follower aligning with the aperture such that, following discharge of a final cartridge from the firearm, the rear projection elevates through the rear aperture and above the top to actuate a bolt catch or separate drop in bolt hold open component incorporated into the firearm (this can include being incorporated into a single receiver firearm or alternatively an upper attachable receiver which secures to a lower receiver in turn having the magazine well), and in order to arrest the forward return motion of the reciprocating bolt following discharge of the last cartridge.

The feed tower is located toward closer to the rear of the magazine body than the front. In certain variants, a feed ramp is integrated into the top of the magazine, proximate the front. The upper receiver further can include either of a custom bolt catch or a bolt hold open adapter which is upwardly engaged by the elevating rear magazine projection in order to arrest a return forward cycling motion of the reciprocating bolt. Alternatively, and in absence of the separate bolt catch or hold open adaptor, at least one variant provides a main contoured upper surface of the follower which, upon discharge of the final cartridge, elevates above the feed lips in order to arrest the return forward cycling motion of the reciprocating bolt.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

With reference to the attached illustrations, the present invention discloses a number of related variants (see with further reference to magazine 10 of FIG. 1, magazine 100 of FIG. 2, and magazine 200 of FIG. 3) of a magazine having a redesign upper end including opposing edge extending (also termed bridge supported) reinforced feed lips extending along both sides of a main opening defined in the magazine for loading the cartridges. As will be further described, an area of the magazine top surrounding the feed lips is substantially closed with the exception of a separate aperture located rearward of the main opening in alignment with an upward follower projection which, upon discharging of a final round, elevates a separate bolt catch or custom drop in bolt hold adaptor into contact with the forwardly displacing bolt. Other features include forming the feed ramp integrally with the magazine tube in order to simplify construction and reduce cost of manufacture.

Figure 1:
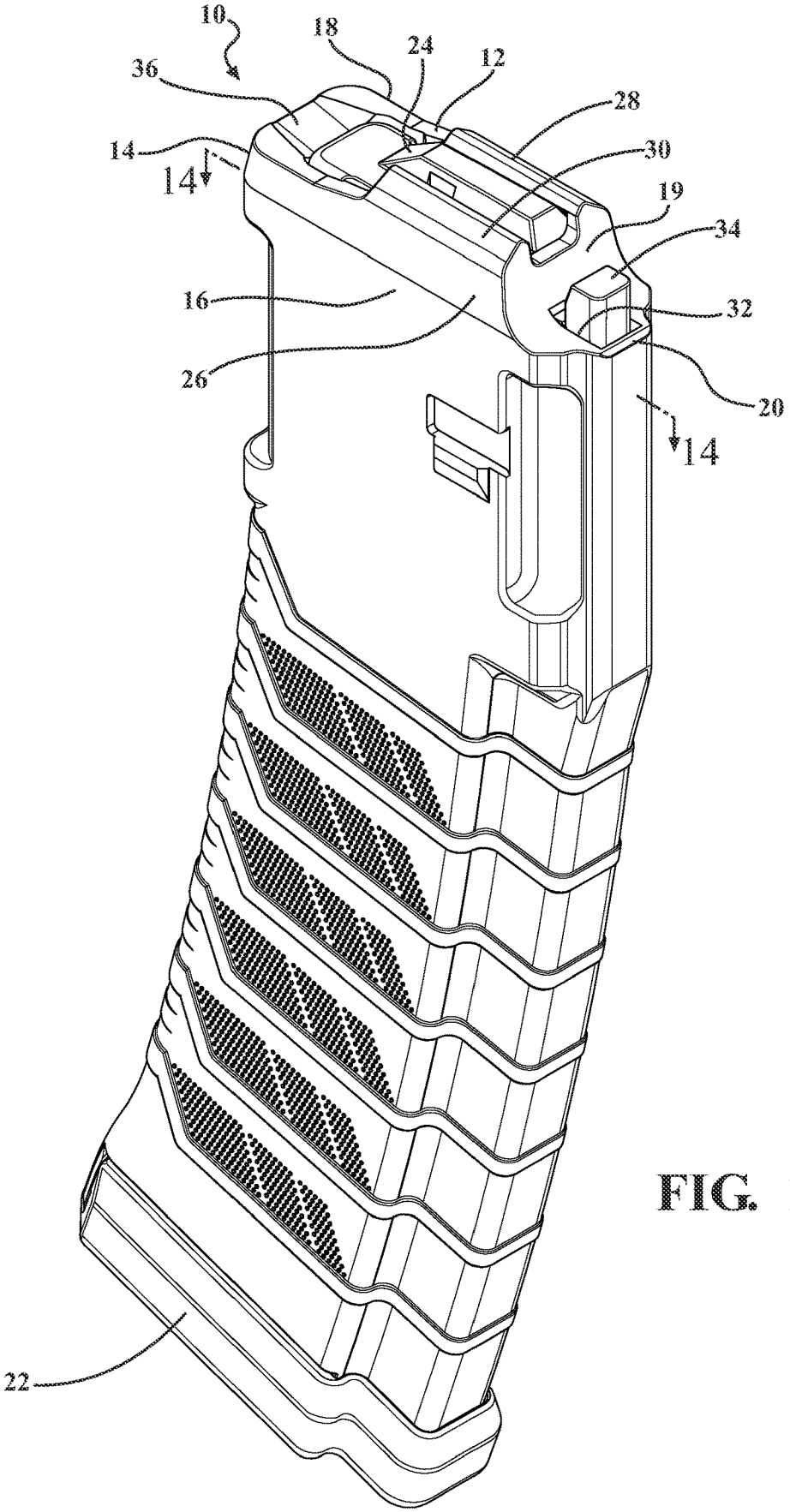
FIG. 1 is a perspective view of a magazine and follower according to a first variant of the present invention including upper end located and reinforced feed lips in combination with a magazine tube integrated feed ramp and rear top aperture for seating the upwardly projecting rear portion of the follower.
Figure 2:
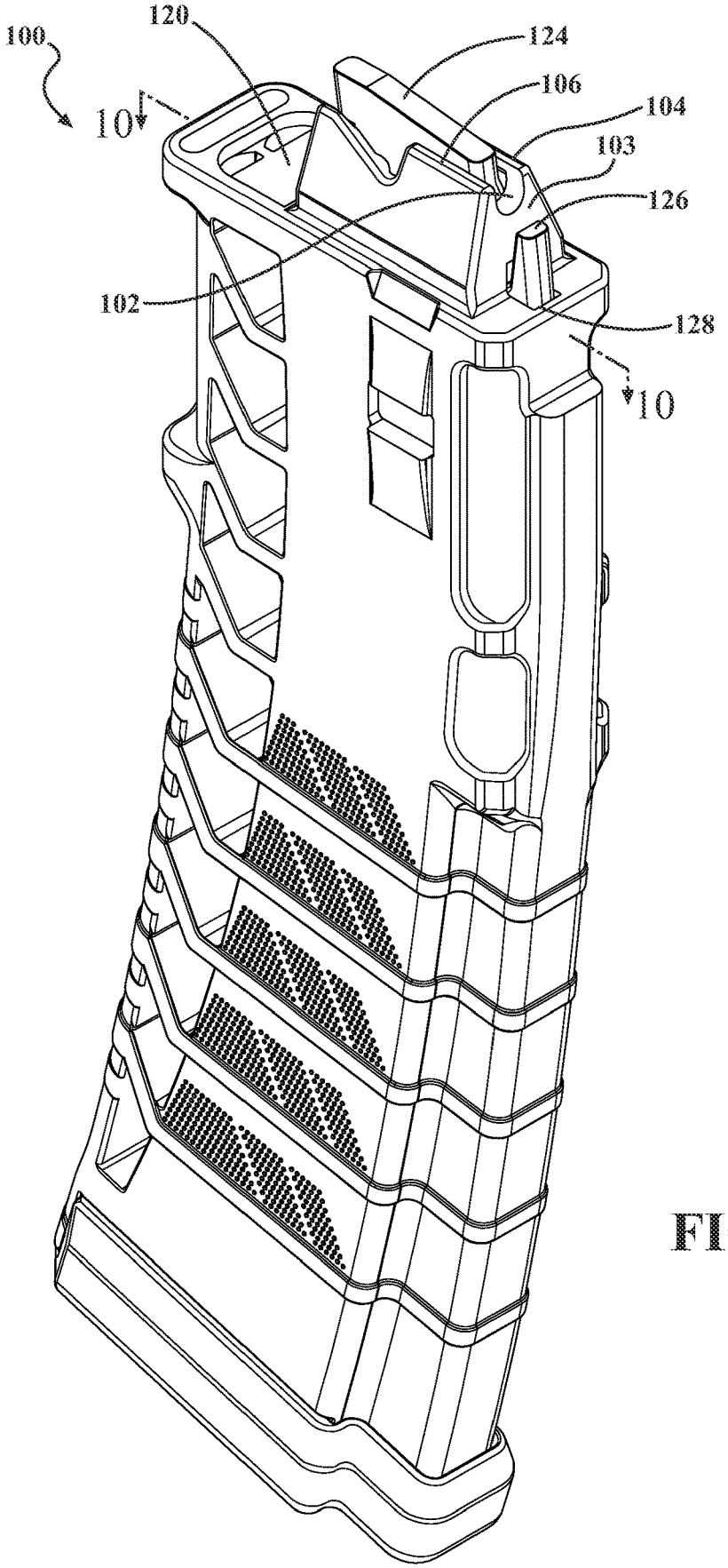
FIG. 2 is a perspective view of another variant of the magazine and follower depicted in FIG. 1 for use with a smaller caliber of ammunition.
Figure 3:
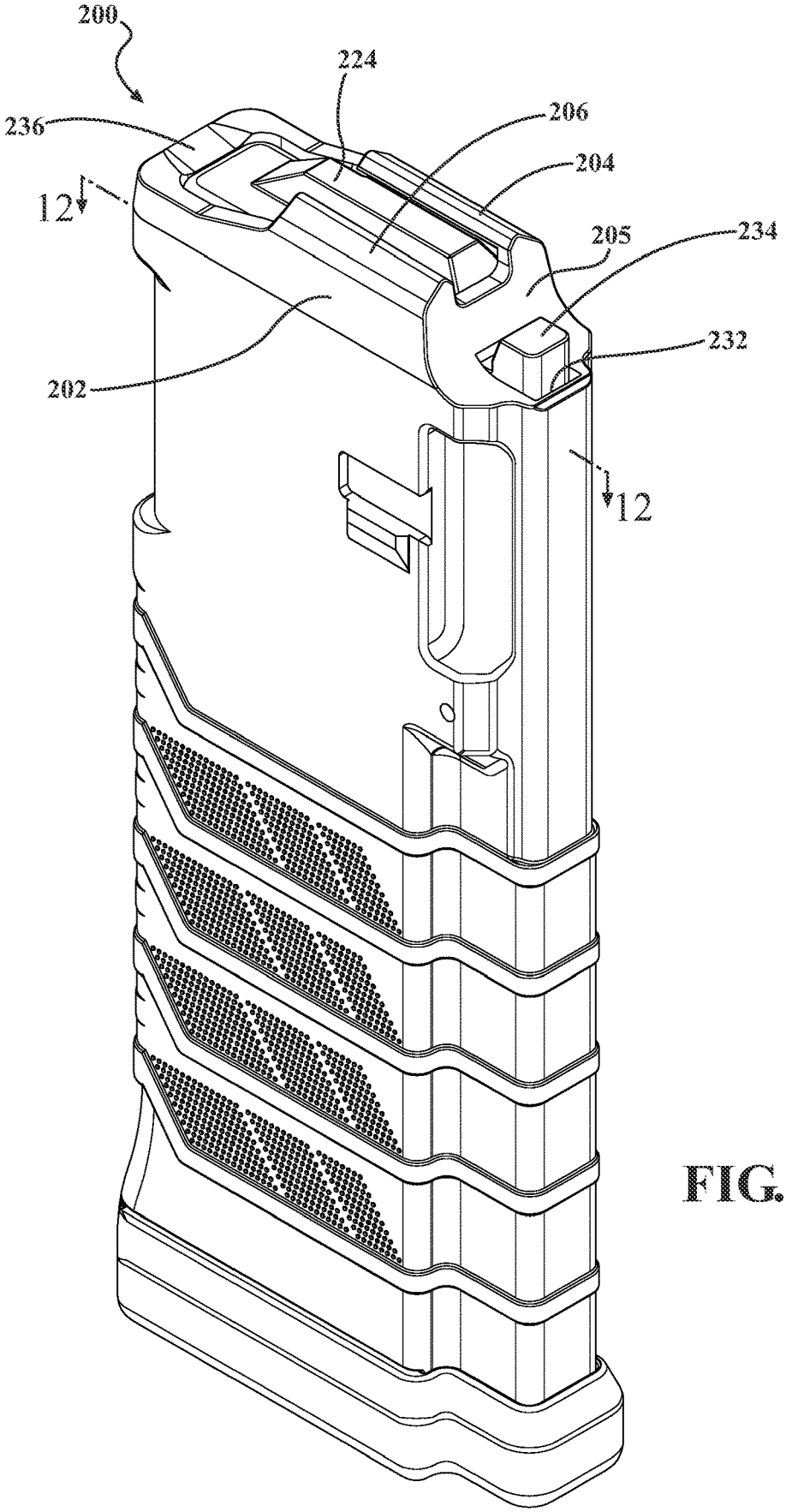
FIG. 3 is a perspective view of a yet further variant of the magazine and follower depicted in FIG. 1 for use with a larger caliber of ammunition.

FIG. 1 is a perspective view, generally at 10, of a magazine and follower according to a first variant of the present invention and including upper end located and reinforced feed lips in combination with a magazine tube integrated feed ramp and rear top aperture for seating the upwardly projecting rear portion of the follower. FIG. 2 is a perspective view of another variant, generally at 100, of the magazine and follower depicted in FIG. 1 for use with a smaller caliber (such as including but not limited to .22 LR) of ammunition and which provides a dual purpose follower for engaging the forward cycling bolt following discharge of a final cartridge. Finally, FIG. 3 provides a perspective view of a yet further variant 200 of the magazine and follower similar to that depicted in FIG. 1 for use with a larger caliber of ammunition.

Figure 7:
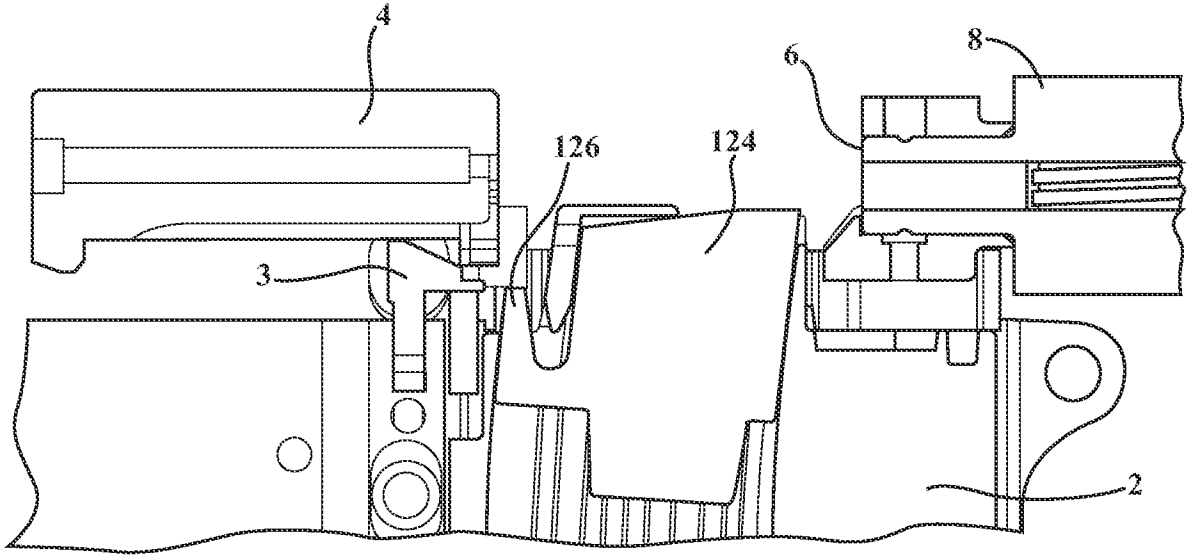
FIGS. 7-7A illustrate first and second cutaway environmental views depicting first and second alternate engagement configurations for the magazine follower interacting with the bolt catch or bolt in order to establish a last shot bolt hold open condition.
Figure 7A:
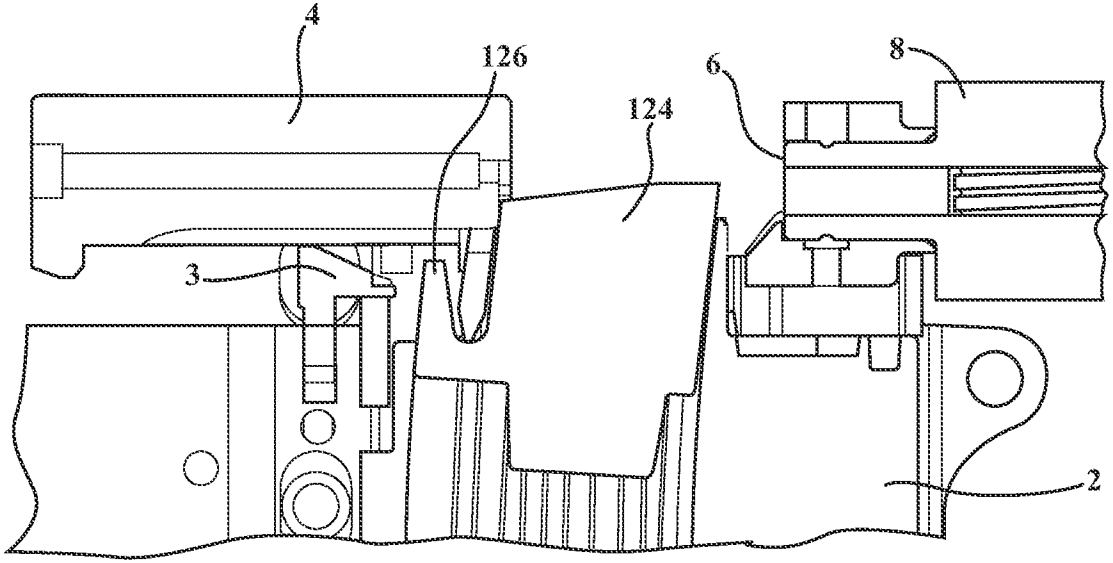

In each instance, and as best shown in the cutaway environmental views of FIGS. 7-7A, the magazine attaches within a magazine well of an AR type lower receiver 2. An upper receiver is attached to the lower receiver in communication with the magazine well, with the outer housing of the upper not shown in order to reference a bolt carrier group 4 which reciprocates in fore and aft directions in overhead communication with the magazine well and, in a forward most position, for chambering a cartridge from the magazine in order to seat against a chamber location 6 communicating with a forward extending barrel 8. With reference again to FIGS. 7-7A, a bolt catch 3 can be associated with a separate drop in component such as a last shot bolt hold open device, this also including other types of bolt hold open adaptors.

In each of the variants 10, 100 and 200, the magazine includes an elongated body installable into the magazine well and (with reference to magazine 10 in FIG. 1) having a top 12, interconnected front 14, sides 16 and 18 and rear 20 walls, and a bottom 22. A spring (not shown) is supported within the interior in contact with a floor retention plate (also not shown) which is incorporated into or otherwise separately attached to close the bottom.

Referring again to FIG. 1 a follower 24 is supported in positioned atop the interior spring so as to be biased in an upward direction toward an opening in the top, through which the cartridges are loaded into the magazine.

A variant of a reinforcing superstructure, also termed a feed tower, is integrated into the top of each magazine configuration and supports a pair of feed lips positioned along opposed edges defining an opening for facilitating the loading of the cartridges. Each of the magazine configurations 10, 100 and 200 exhibits a different configuration of feed tower, with magazine 10 showing a tower 26 with upper configured feed lips 28 and 30 which are further connected at 19 as shown in FIG. 1 as well as to interconnected the separate rear aperture 32 for seating the rear upward projection 34. As described herein, the feed lips are defined as an integral part of the body, such as which can be constructed from an injection molded plastic. The construction of the feed lips 28/30 with reinforced connection 19 are reinforced to limit outward swelling in response to the upward forces exerted by the spring against the inserted cartridges.

Figure 6A:
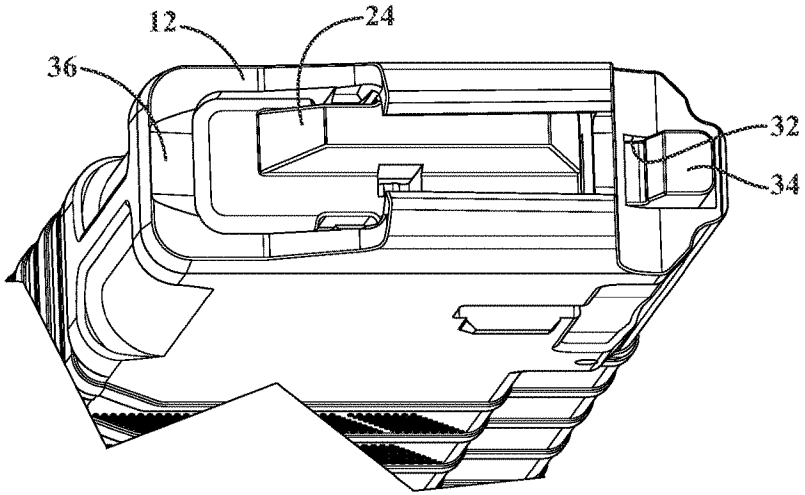
FIG. 6A is a top perspective of the variant of FIG. 3.
Figure 6:
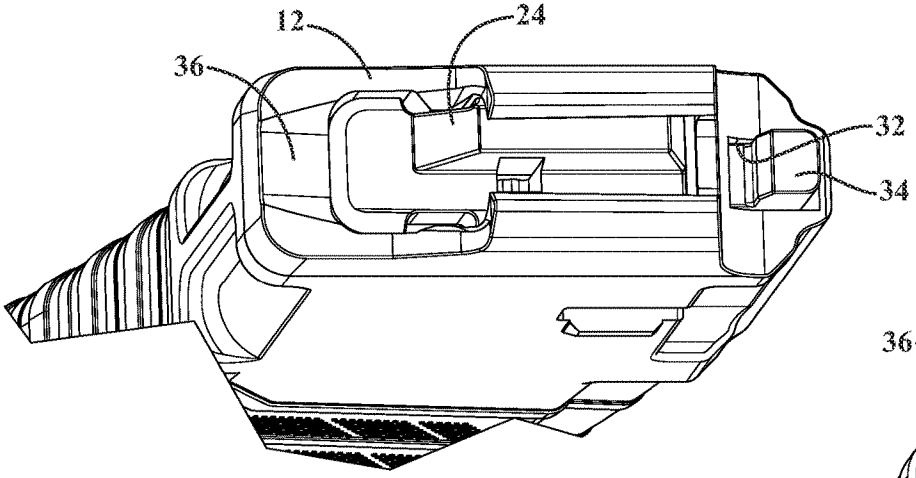
FIG. 6 is a top perspective of the variant of FIG. 1.
Figure 6B:
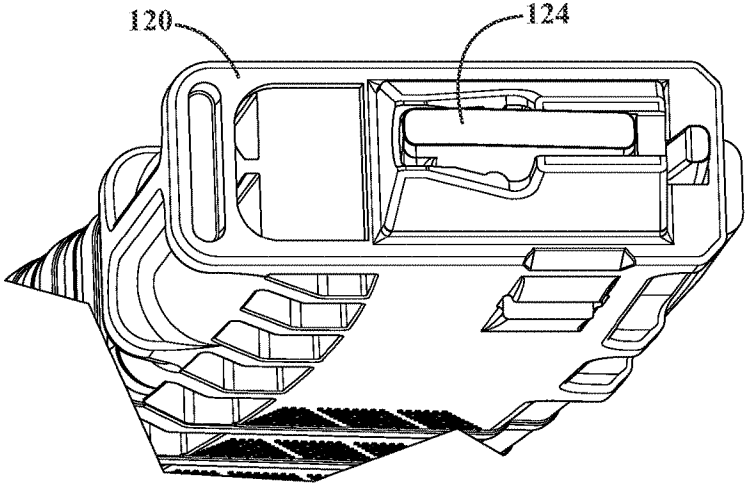
FIG. 6B is a partial top perspective of the variant of FIG. 2.

As further shown in FIG. 1, the aperture 32 formed in the top 12 (see also FIGS. 6-6B) is positioned rearward of the feed tower, with the rear upward projection 34 of the follower aligning with the aperture such that, following discharge of a final cartridge from the upper receiver, the rear projection 34 elevates above the top 12 of the magazine in order to arrest the forward returning motion of the bolt. This is best depicted in FIGS. 7-7A which illustrate first and second cutaway environmental views depicting first and second alternate engagement configurations for the magazine follower (this at 124 for the variant of FIG. 2) interacting with the bolt catch or bolt in order to establish a last shot bolt hold open condition. The follower 124 includes a rear attached and upwardly extending projection 126 which aligns with a separate rear slot or aperture 128 (from the main opening defined between the feed lips 104/106 in the rear of the magazine top 120 as again shown in FIG. 2). The magazine of FIG. 2 also depicts a rear reinforced connection 103 established between the feed lips 104/106 as shown, again for separating the rear aperture 128 as well as for preventing outward swelling of the feed lips in response to upward forces exerted upon the inserted cartridges by the spring.

Also depicted in FIG. 1 is a forward located feed ramp 36 integrated into the top 12 of the magazine assisting in feeding of cartridges into the upper receiver chamber. A similar feed ramp 236 is configured into the forward top location of the corresponding magazine design 200, with the smaller caliber magazine 100 (such as utilized with a smaller caliber cartridge including a .22 LR) not including a similarly configured feed ramp.

The smaller caliber magazine 100 in FIG. 2 is again shown and corresponds to most of the features of the corresponding magazine 10 of FIG. 1, except as to a redesign of the feed tower which depicts a curved end profile at 102 separating the feed lips 104/106 and defining the reinforced connection 103 and extending upwardly from a top 120 of the magazine and through which projects the inner spring supported follower 124 in the uppermost position. An upper contoured edge the main follower body, again at 124, can be ascending at a forward end, this in order to provide the dual function (otherwise provided by the rear attached and upwardly extending projection 126 seating through separate aperture 128) of restraining the return motion of the bolt and in order to establish a last shot bolt hold open condition.

A reconfiguration of the feed lips (see at 104 and 106) is provided at the top of the feed tower, through which the cartridges (not shown) successively fed or loaded into the magazine. The feed lips 104 and 106 again are reinforced (see again at 103) and prevented from flexing owing to their construction incorporated into the superstructure or feed tower.

The magazine design of FIG. 3 is substantially similar to FIG. 1 except as to scale or cartridge size, with similar features depicted including the arrangement of a feed tower 202 with opposing upper edge arranged and reinforced feed lips 204/206 (see also reinforced connection 205 established between the feed lips opposing the main opening and the separate rear aperture 232), between which projects a main portion of the follower (at 224). The follower also again includes a rear attached and upward projecting portion referenced at 234 which, similar to that depicted at 34 in FIG. 1, actuates upwardly through the separate aperture 232 defined rearwardly of the main opening (as defined by the feed lips connecting/reinforcing portion 205 of the magazine tower) for seating the main body portion 224 of the follower in response to a final discharged cartridge, and so that the rear portion 234 in turn upwardly displace a bolt catch or other customized drop in component in order to arrest a forward return cycling of the reciprocating bolt to maintain the chamber in the open position. As with the embodiment of FIG. 1 (at 36), a forward feed ramp 236 is shown in FIG. 3 which is integrated into the top of the magazine.

Figure 8A:
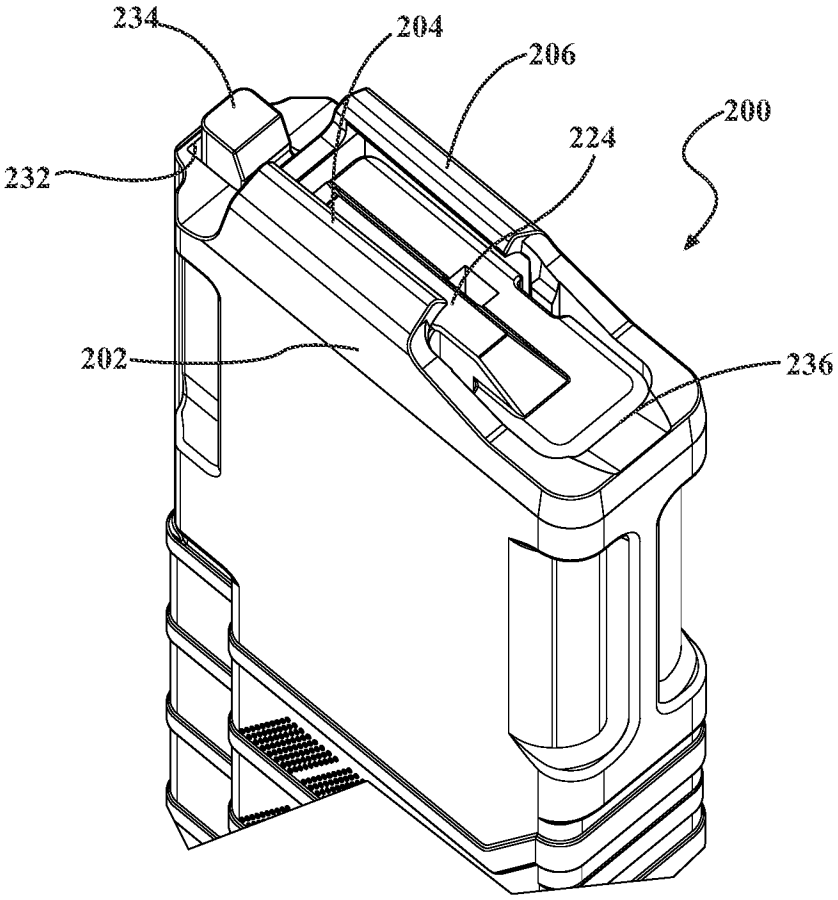
FIGS. 8-8A depict a pair of upper perspective views of the magazines of FIGS. 1 and 3 and better showing the upper feed ramp integrated into the body of the magazine.
Figure 8:
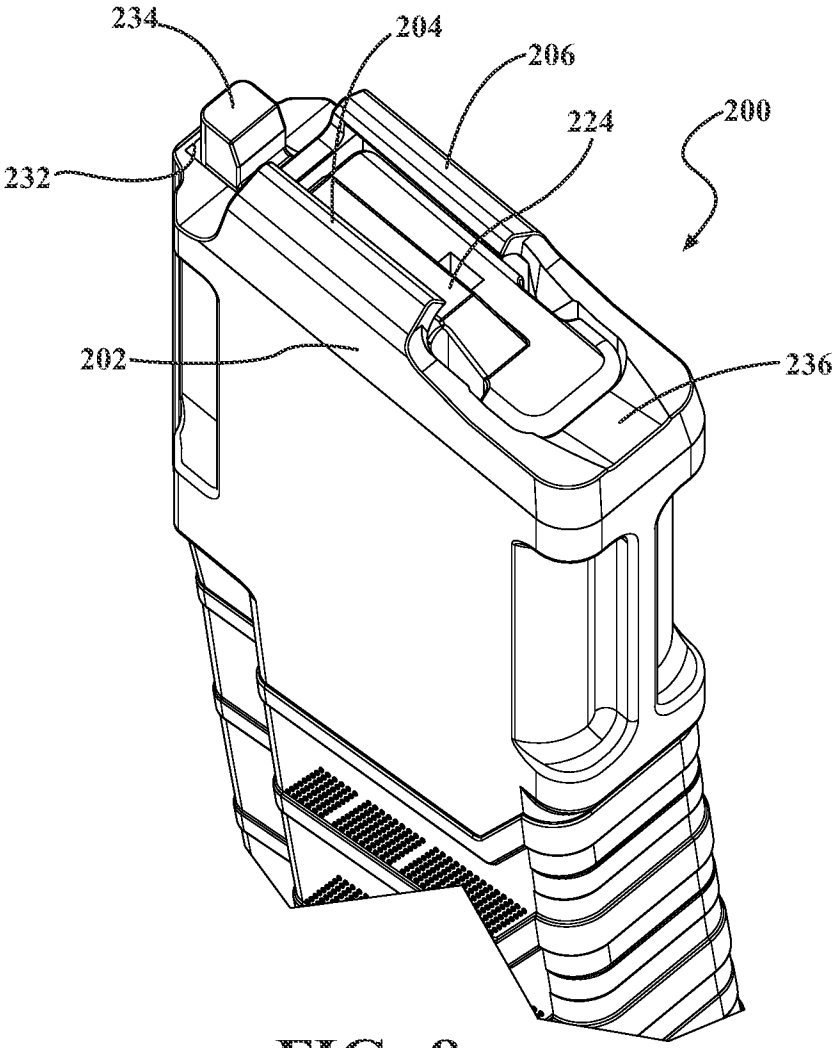

FIGS. 8-8A depict a pair of upper perspective views of the magazines of FIGS. 1 and 3 and better showing the upper feed ramp 236 integrated into the body of the magazine variant 200. The construction of the magazine top is further such that the feed tower construction (at 202) provides reinforcing support to the upper feed lips 204/206 in order to prevent deformation or bowing during feeding or retention of the cartridges and owing to the associated spring biasing forces exerted upon the upward biased follower. In this manner, a polymeric magazine construction can provide the necessary structural support for feeding larger caliber ammunition.

As again shown in related magazine variant 200 in FIG. 3, rear located aperture 232 in the otherwise closed outer perimeter of the magazine top aligns with the upper projecting rear portion 234 of the follower 224. As previously described, the rear projection 234 upwardly ascends in order to engage any bolt catch or drop in component (such as a last shot bold hold open component) following discharge of a final round.

FIG. 4 again provides an enlarged top end perspective of the version of the magazine and follower depicted in FIG. 2 and better illustrating the bridging reinforcement connecting portion 103 of the tower structure and including the curved end profile 102 between the upper feed lips 104/106. As shown, the connecting portion 103 separates the main cartridge receiving interior from the rear located aperture 128 formed in the closed outer perimeter of the magazine top for seating the rear projecting follower portion 126. The cartridge rounds are presented forward of the rear position to allow space for the bridge constructed along the back of the feed lips 104/106. The variant provides a dual-purpose follower in which the main portion 124 provides for forward arresting engagement of the cycling bolt, this as a back up to the rear magazine projection 126 for engaging a bolt catch or other suitable drop in component.

Figure 4:
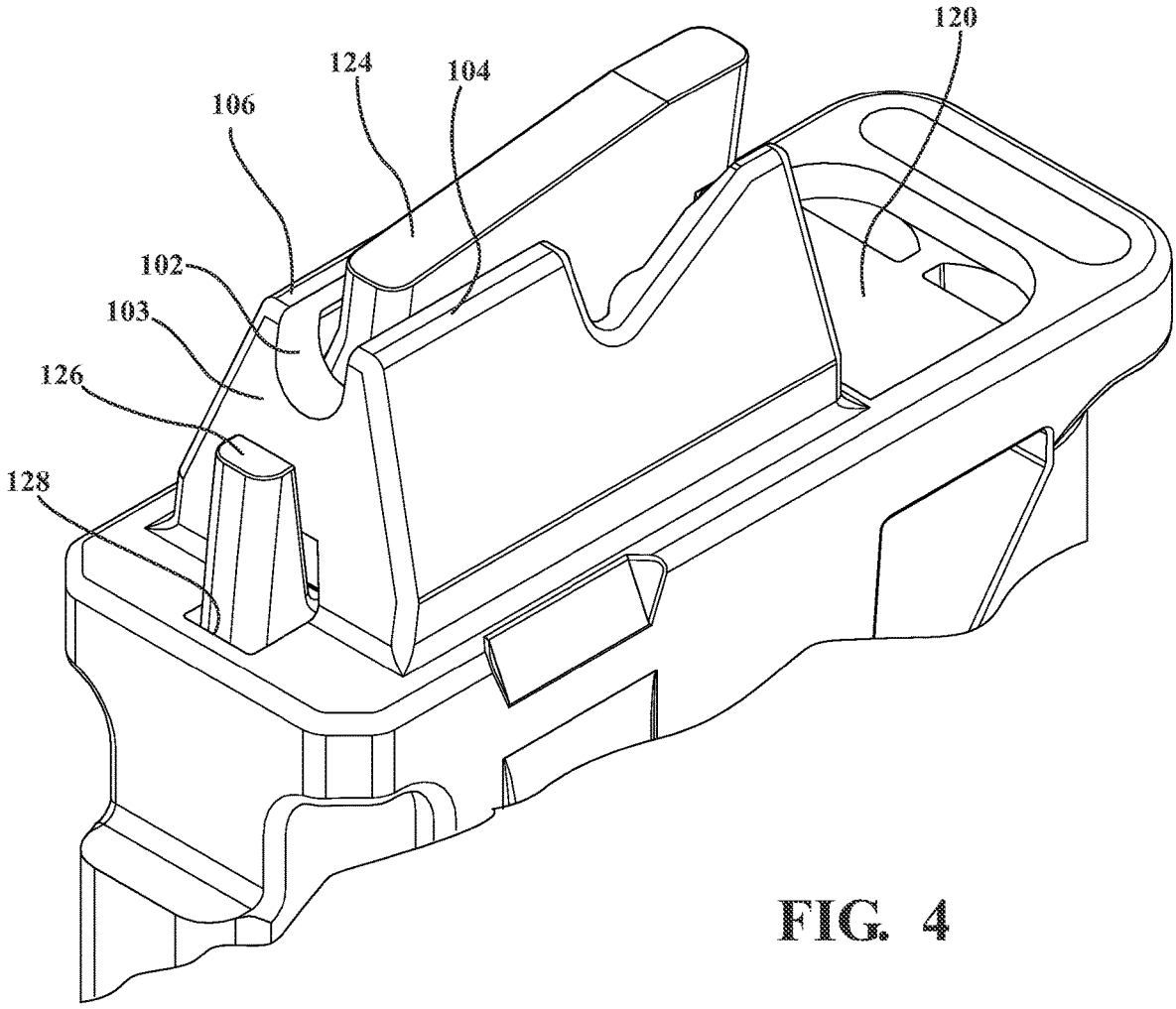
FIG. 4 is an enlarged top end perspective of the version of the magazine and follower depicted in FIG. 2 and better illustrating the bridging reinforcement between the upper feed lips, along with the aperture formed in the closed outer perimeter of the magazine top end surrounding the bridge supported feed lips.

As further shown in FIG. 4, the curved end profile 102 in combination with the reinforced connection 103 stiffens the feed lips 104/106 to reduce swelling issues commonly seen in polymer magazines. In typical AR15 magazines, the back of the magazine may be slotted to allow room for the follower to contact the bolt catch after the last round has been fired. Such prior constructions have been found to cause structural instability in the magazine design and to increase the incidence of deformation of the magazine upper and feed lips in order to properly retain and feed the rounds.

Figure 5B:
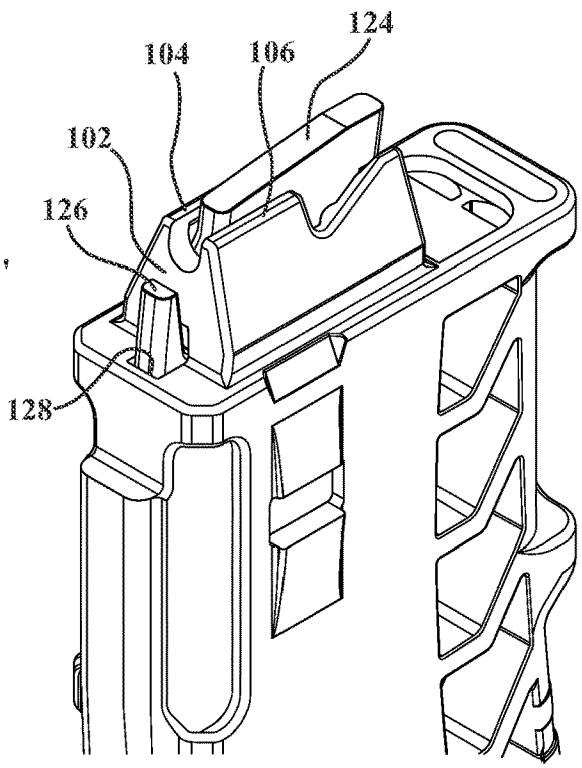
FIG. 5B is a partial upper perspective of the upper magazine shown in FIG. 2.
Figure 5A:
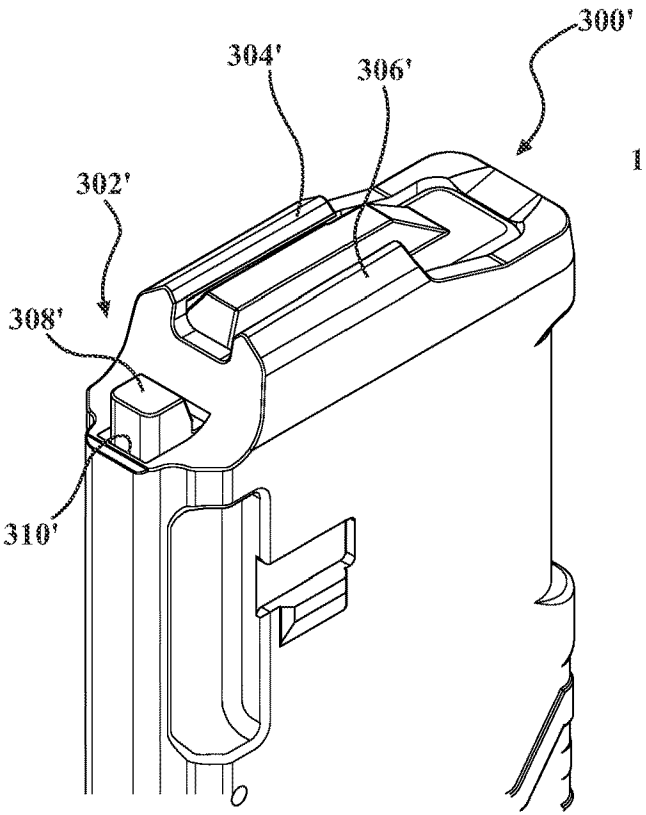
FIG. 5A is an illustration similar to FIG. 5 of a further related variant of upper magazine feed lips and bridging structure.
Figure 5:
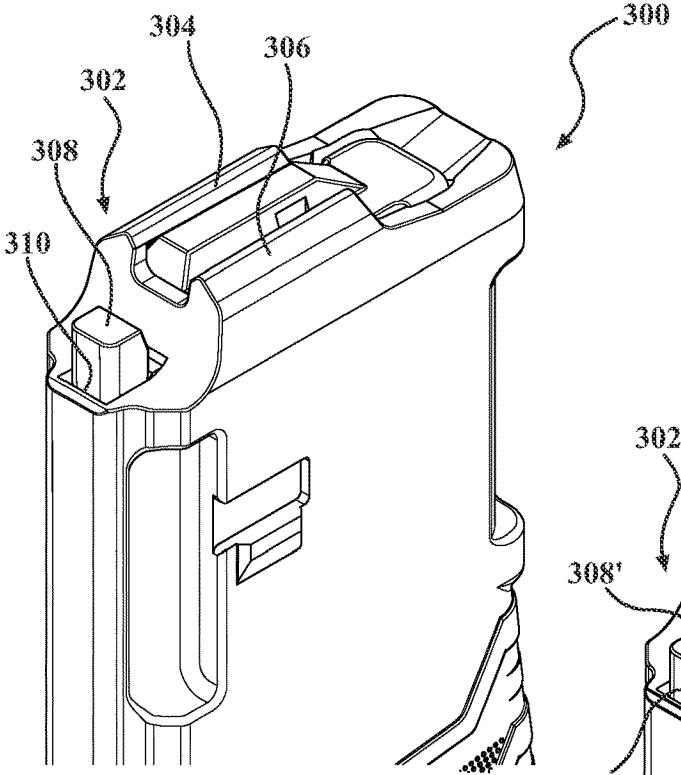
FIG. 5 is an upper perspective of a magazine and follower according to a related variant and including a bridging construction between the feed lips to prevent flexing under a full magazine load.

FIG. 5 is an upper perspective of a magazine and follower according to a related variant, generally at 300, and including a bridging construction 302 between the feed lips, at 304 and 306, to prevent flexing under a full magazine load. A rear integral projection 308 of the follower ascends upwardly through an aligning aperture 310 in the otherwise closed outer perimeter of the magazine top, such that additional reinforcing support is imparted to the magazine construction to prevent deformation or bowing in response to the spring loaded upward forces exerted upon and in turn by the magazine follower.

FIG. 5A is an illustration similar to FIG. 5 of a further related variant 300' of upper magazine feed lips 304'/306' and bridging structure 302'. A rear integral follower projection is again shown, at 308', and ascends upwardly through an aligning aperture 310' in the otherwise closed outer perimeter of the magazine top, such that additional reinforcing support is again imparted to the magazine construction to prevent deformation or flex/bowing in use.

FIG. 5B is a partial upper perspective of the upper magazine shown in FIG. 2 and as substantially shown in FIG. 4 and better illustrating the configuration of the upward rear follower projection 126 ascending through the rear aperture 128. As previously described, the follower 124 is dual purpose in that either the main body of the follower or the rear projection 126 can engage the forward return cycling bolt (in the instance of the main body engaging the bolt directly and in the further instance of the rear projection 126 via a bolt catch or other customized drop in component).

Figure 9:
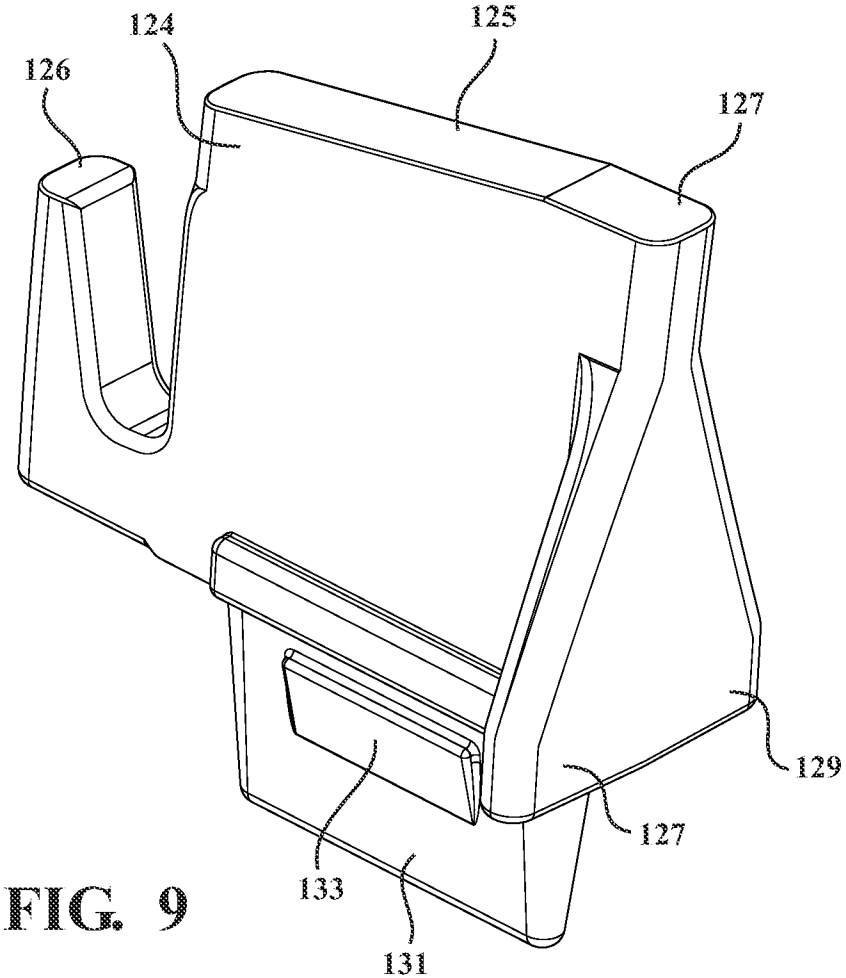
FIG. 9 is a perspective view of the follower of FIG. 2, removed from the magazine.

Proceeding to FIG. 9, a perspective view is shown of the follower 124 of FIG. 2, removed from the magazine 100. This magazine and follower combination typically references a smaller caliber cartridge, such as a .22 lr. The follower 124, includes an inwardly tapered and narrowed main body terminating in an upper planar surface including an upwardly sloping portion 125 and interconnected apex surface 127. As previously described, this profile provides the .22 lr follower with the dual function of either the main body 124 of the follower or the rear projection 126 engaging the forward return cycling bolt (in the instance of the main body engaging the bolt directly as well as in the further instance of the rear projection 126 via a bolt catch or other customized drop in component). The .22 lr follower 124 further includes a forward end located and downwardly flared configuration (see wings 127 and 129). A base portion 131 of the follower 124 includes a reverse flared configuration with side tabs (one of which is shown at 133) for seating an upper edge of the magazine spring (not shown).

Figure 10:
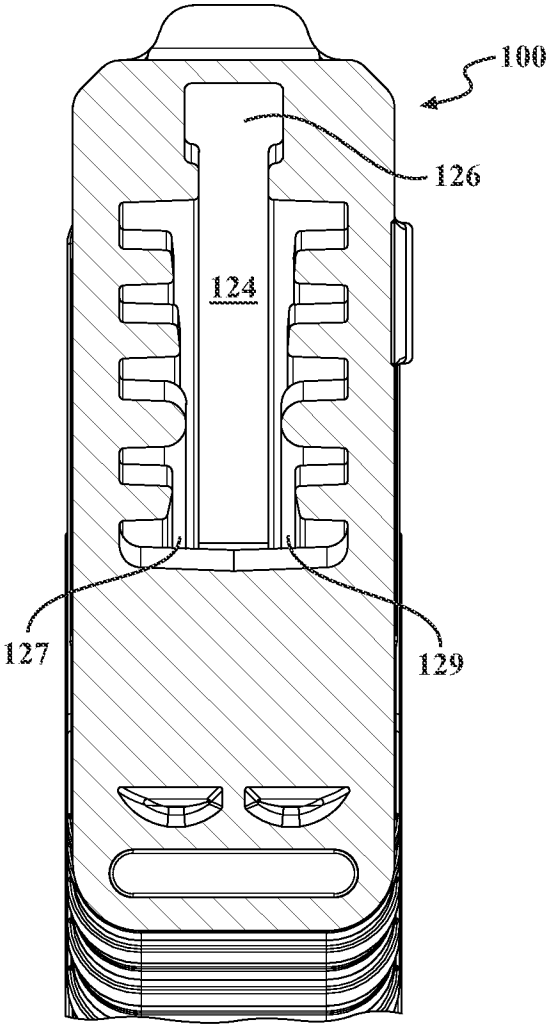
FIG. 10 is a cutaway view taken along line 10-10 of FIG. 2 and depicting a seating profile established between the magazine interior and the biasingly supported follower.

FIG. 10 is a cutaway view taken along line 10-10 of FIG. 2 and depicting a seating profile established between the magazine interior 100 and the biasingly supported follower. The forward end winged profiles 127/129 of the follower body seat within an otherwise open interior of the magazine interior and which, upon discharge of a final cartridge, provide adequate elevating guidance to the follower in the manner depicted in FIG. 2.

Figure 11:
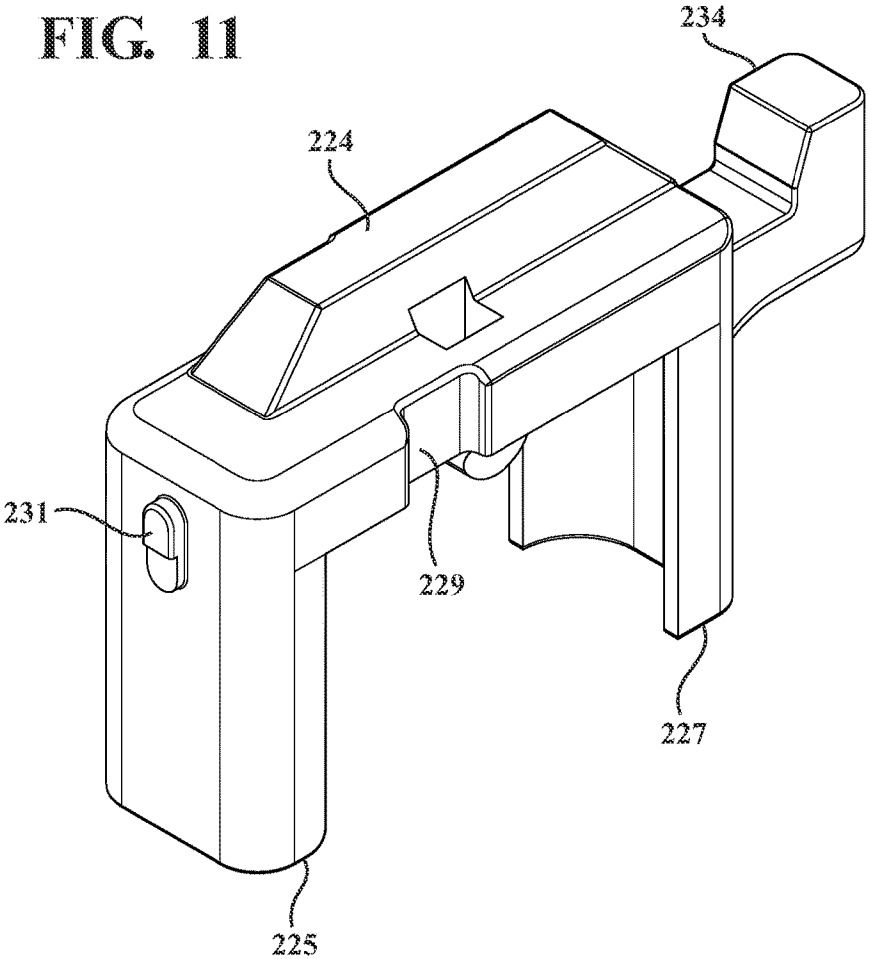
FIG. 11 is a perspective view of the follower of FIG. 3, removed from the magazine.

FIG. 11 is a perspective view of the follower of FIG. 3, removed from the magazine, and which can include for use with such as a 5.7×28 mm sized cartridge. As previously described, the follower includes a trapezoidal shaped and flattened upper profile. A pair of downward extending legs 225 and 227 define inner arcuate profiles which seat the magazine spring therebetween within the magazine interior.

Figure 12:
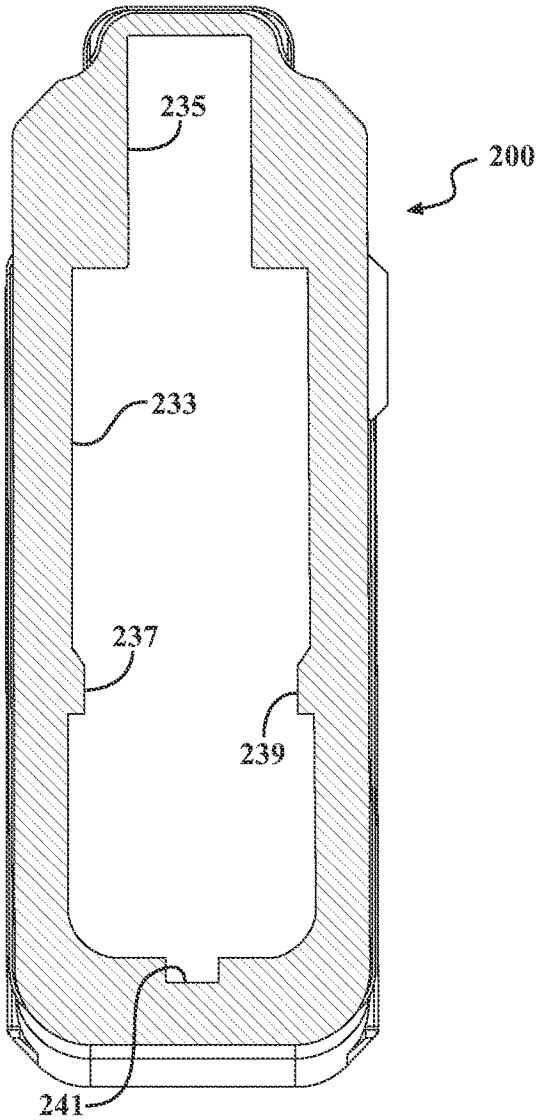
FIG. 12 is a cutaway view taken along line 12-12 of FIG. 3 and depicting a seating profile established between the magazine interior and the biasingly supported follower.

Also depicted are side notches 229 and a small raised pad 231 on the front one of the legs 225 which, when seated within the cutaway of the magazine interior as shown in FIG. 12, provides a guided seating profile established between the magazine interior and the biasingly supported follower. As further shown in FIG. 12, the cutaway profile of the magazine 200 seats the follower 224 in manner preventing any misalignments during operation and includes each of a main outline 233 for seating the main follower body 224, a rearward narrowed portion 235 for seating rearward projection 234, a pair of side locating features 237/239 for seating the follower side notches 229 and a forward notch 241 for seating the smaller forward projection 231.

Figure 13:
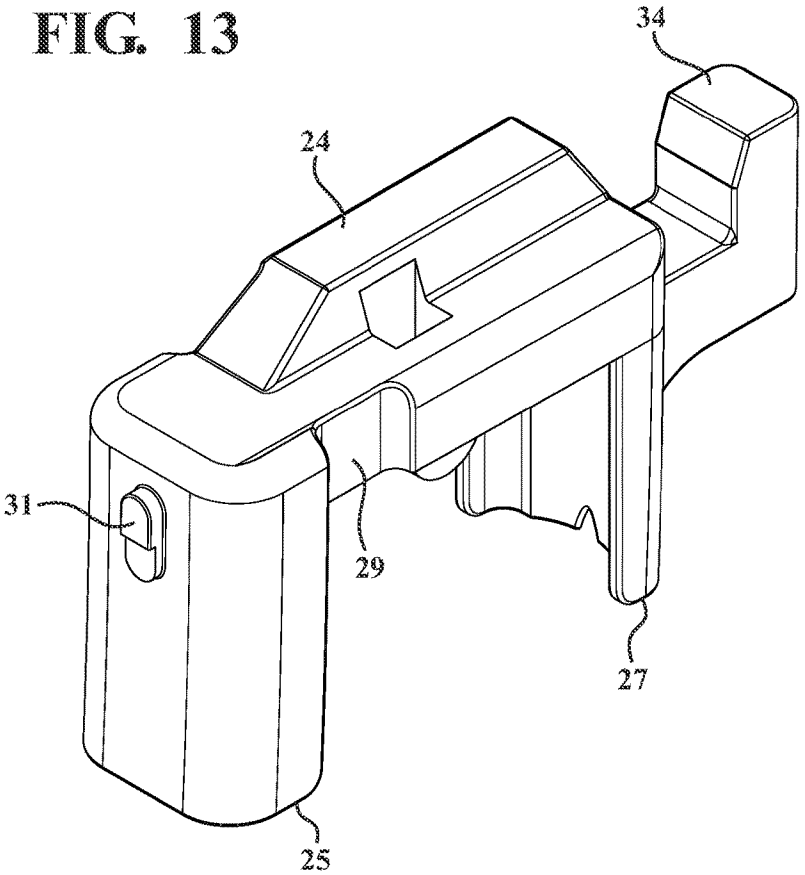
FIG. 13 is a perspective view of the follower of FIG. 1, removed from the magazine.

FIG. 13 is a perspective view of the follower 24 of FIG. 1, also removed from the magazine, and similar to the variant in FIG. 11, also includes a trapezoidal shaped and flattened upper profile, a pair of downward extending legs 25 and 27 define inner arcuate profiles which seat the magazine spring therebetween within the magazine interior, side notches 29 and a small raised pad 31 on the front one of the legs 25 which, when seated within the cutaway of the magazine interior as shown in FIG. 12, and provides a guided seating profile established between the magazine interior and the biasingly supported follower.

Figure 14:
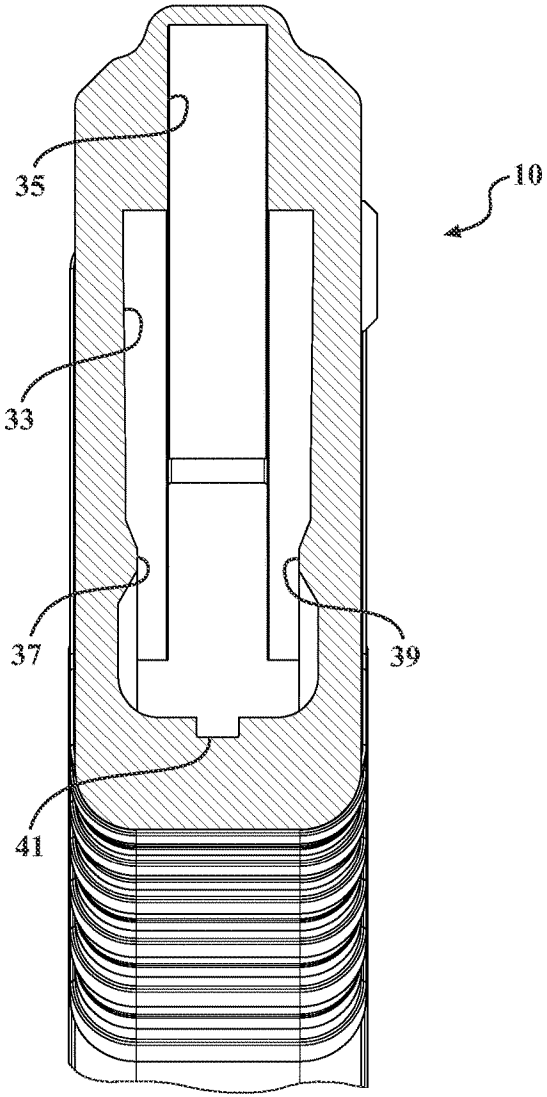
FIG. 14 is a cutaway view taken along line 14-14 of FIG. 1 and depicting a seating profile established between the magazine interior and the biasingly supported follower.

Finally, FIG. 14 is a cutaway view taken along line 14-14 of FIG. 1 and depicting a similar seating profile established between the magazine interior and the biasingly supported follower of FIG. 13. This again includes a main outline 33 for seating the main follower body 224, a rearward narrowed portion 35 for seating the follower rearward projection 34, a pair of side locating features 37/39 for seating the follower side notches 29, and a forward notch 41 for seating the smaller forward projection 31.

In each of the above variants 10, 100 and 200 of the magazine, the upper incorporated feed lips are physically connected and reinforced at the rear of the magazine. In comparison to previous magazine designs, in which the feed lips weren't connected and the follower extended between them to the rear of the magazine as a single piece, the reinforced construction of the feed lips avoids instances of swelling which, in extreme cases, allows rounds slip out the top of the magazine. Furthermore, and by connecting the feed lips in the manner provided in the present invention, instances of swelling is eliminated.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The foregoing disclosure is further understood as not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, a person of ordinary skill in the art will recognize that changes may be made in form and detail without departing from the scope of the present disclosure. Thus, the present disclosure is limited only by the claims.

In the foregoing specification, the disclosure has been described with reference to specific embodiments. However, as one skilled in the art will appreciate, various embodiments disclosed herein can be modified or otherwise implemented in various other ways without departing from the spirit and scope of the disclosure. Accordingly, this description is to be considered as illustrative and is for the purpose of teaching those skilled in the art the manner of making and using various embodiments of the disclosure. It is to be understood that the forms of disclosure herein shown and described are to be taken as representative embodiments. Equivalent elements, materials, processes or steps may be substituted for those representatively illustrated and described herein. Moreover, certain features of the disclosure may be utilized independently of the use of other features, all as would be apparent to one skilled in the art after having the benefit of this description of the disclosure. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

Further, various embodiments disclosed herein are to be taken in the illustrative and explanatory sense, and should in no way be construed as limiting of the present disclosure. All joinder references (e.g., attached, affixed, coupled, connected, and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", "third", "primary", "secondary", "main" or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to, or over, another element, embodiment, variation and/or modification.

It will also be appreciated that one or more of the elements depicted in the drawings/figures can also be implemented in a more separated or integrated manner, or even removed or rendered as inoperable in certain cases, as is useful in accordance with a particular application. Additionally, any signal hatches in the drawings/figures should be considered only as exemplary, and not limiting, unless otherwise specifically specified.

The invention claimed is:

1. A magazine for use with a firearm having a receiving well in communication with a reciprocating bolt, said magazine comprising:

a body adapted to being secured into the well, said body having a top, interconnected front, side and rear walls, and a closed bottom defining a cartridge holding interior;

a follower having each of a main portion and a rear attached and upwardly projecting portion, said follower supported within said body against a spring supported within said body so that said main portion is influenced toward a main opening defined in said top through which the cartridges are loaded to downwardly depress said follower against said spring;

a feed tower integrated into said top and incorporating a pair of connected feed lips extending along opposed edges defining the main opening; and a separate aperture defined in said top and located rearward of said connected feed lips opposing said main opening, said aperture being in alignment with said rear attached and upwardly projecting portion; and following discharge of a final cartridge from the upper receiver, said rear projecting portion elevating through said aperture to contact and in turn elevate a separate component incorporated in firearm for arresting forward return cycling of the bolt.

2. The magazine of claim 1, further comprising said feed tower being located closer to said rear of said magazine body than said front.

3. The magazine of claim 1, further comprising a feed ramp integrated into said top proximate said front.

4. The magazine of claim 1, said separate component incorporated into the firearm including a bolt catch.

5. The magazine of claim 1, said separate component incorporated into the firearm including a bolt hold open adaptor.

6. The magazine of claim 1, said body including said feed tower being constructed of an injection molded plasticized material, said connected feed lips reducing outward swelling resulting from upward bias exerted by said spring against the cartridges.

7. The magazine of claim 1, said closed bottom further comprising a floor plate attachable to said body.

8. The magazine of claim 1, said main portion of said follower further comprising an upper contoured edge ascending at a forward end which, following discharge of the final cartridge, elevating above said feed lips to arrest the forward return cycling of the bolt separate from said rear attached and upwardly projecting portion.

9. The magazine of claim 1, the firearm further including a lower receiver incorporating the well and an attachable upper receiver incorporating the reciprocating bolt.

10. The magazine of claim 1, said main portion of said follower further comprising an inwardly tapered and narrowed shape terminating in an upper planar surface including an upwardly sloping portion and interconnected apex surface.

11. The magazine of claim 10, said follower further comprising a forward end located and downwardly flared wings, a base portion of said follower including a reverse flared configuration with side tabs for seating an upper edge of the magazine spring.

12. The magazine of claim 1, said main portion of said follower further comprising a trapezoidal shaped and flattened upper profile, a pair of downward extending legs defining inner arcuate profiles which seat said spring therebetween within the magazine interior.

13. The magazine of claim 12, said follower further comprising each of side notches in said main portion and a small raised pad on a front one of said legs which, when seated within the magazine interior, provides a guided seating profile established between the magazine interior and the biasingly supported follower.

* * * * *